US007212756B2

(12) United States Patent
Nagata

(10) Patent No.: US 7,212,756 B2
(45) Date of Patent: May 1, 2007

(54) IMAGE FORMING APPARATUS WITH EXTRAORDINARY STATE DETECTION

(75) Inventor: Masato Nagata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/371,453

(22) Filed: Feb. 21, 2003

(65) Prior Publication Data

US 2003/0161646 A1 Aug. 28, 2003

(30) Foreign Application Priority Data

Feb. 28, 2002 (JP) ..... 2002-055056

(51) Int. Cl.
*G03G 15/00* (2006.01)
*G03G 21/20* (2006.01)

(52) U.S. Cl. ..... 399/38; 92/94

(58) Field of Classification Search ..... 399/38, 399/44, 69, 70, 91, 92, 94
See application file for complete search history.

(56) References Cited

U.S. PATENT DOCUMENTS 4,338,023 A * 7/1982 McGibbon
5,365,311 A * 11/1994 Matsuoka

FOREIGN PATENT DOCUMENTS

JP 63058371 A * 3/1988
JP 2000332927 A * 11/2000
JP 2002347313 A * 12/2002

* cited by examiner

*Primary Examiner*—David M. Gray
*Assistant Examiner*—Ryan Gleitz
(74) *Attorney, Agent, or Firm*—Akin Gump Strauss Hauer & Feld, LLP

(57) ABSTRACT

To provide a printing apparatus capable of preventing a extraordinary rising of temperature from happening even if a cooling ability is lowered with respect to objects to be cooled.

In the printing apparatus, a host device 1 is connected with a system bus 3 via an interface 2, in a system bus 3, a processor 4, a program ROM 5, a working memory 6, a font ROM 7, an image memory 8 and a print engine interface 9 are connected, on the print engine interface 9, a print engine 20 is connected, further, the processor 4 has a function to change into a low consumption electricity mode, and has a low consumption electricity changing register 41.

16 Claims, 12 Drawing Sheets

PRIOR ART

IMAGE FORMING APPARATUS WITH EXTRAORDINARY STATE DETECTION

BACKGROUND OF THE INVENTION

1. Field of the Invention

The present invention relates to an image forming apparatus which performs image forming form image data; for example, a printer, a facsimile, a copying machine, an image processing apparatus with image presenting section etc.

2. Description of the Related Art

An example of image forming apparatus is a printer. A printer performs printing the image data on a paper. There are various kinds of printers such as printers of electro-photography, thermal transcribing, wire dotting etc.

FIG. 11 shows a configuration of a conventional printer adopting electro-photography.

As shown in FIG. 11, a host device 1 is connected via interface 2 to system bus 3. And, processor 4, program ROM 5, working memory 6, font ROM 7, image memory 8, print engine interface 9 are connected to the system bus 3. Further, a print engine as image forming section 20 is connected to the print engine interface 9.

An image processing section 10 is made up of elements from the interface 2 to the print engine interface 9. The image forming section 20 comprises controlling unit 21 and print mechanism 22. Moreover, fan 23 is equipped to the print mechanism 22.

The host device 1 is what makes up data for printing, such as computer, word processor, image reader etc. And, the interface 2 is a circuit which comprises RS232C interface or parallel interface etc. The processor 4 performs the overall control of the printer as an image forming apparatus. The control program which is executed in the processor 4 is installed in the program ROM 5.

Moreover, the working memory 6 is a memory for memorizing and managing data which is received or sending via the interface 2. And, the font ROM 7 is a memory which is used for transforming character code or other code received via the interface 2, into bitmap font data for printing.

Moreover, the image memory 8 comprises random access memory for containing for example one page of printing data which is an image data edited by the processor 4. The print engine 20 is a device which performs printing on papers according to the printing data contained in the image memory 8. It comprises paper carrier or electro-photographic process device etc.

The print engine interface 9 is an interface circuit for reading out printing data 9*a* from image memory 8 according to the indication of processor 4 to transfer it to print engine 20, or receiving print control signal 9*b* put out from print engine 20 to send it to processor 4 etc.

In the printer mentioned above, control command or character code, graphic code, bitmap image data etc. are temporarily contained in working memory 6 if necessary. And, it is transformed into image data for printing according to the control of processor 4, to be compiled on image memory 8.

As mentioned above, when characters are printed, the bitmap font contained in font memory 7 is used. But, in the occasion when the bitmap data corresponding to the character to be printed is not contained in font memory 7, the bitmap data is obtained from DLL (Down Line Loading) font of the host device 1. And, this data is registered in a certain area of DLL memory 6*a* in working memory 6.

Moreover, in the occasion when high resolution printing is performed the image memory 8 needs large capacity fit for the high resolution. Therefore, a method for realizing high resolution with comparatively small capacity of memory at low cost is offered by the applicant of the present invention (JP 63-146764, 1988).

FIG. 12 shows an example of the side view of the printer as image forming apparatus in FIG. 11.

In FIG. 12, charging roller 101 supplies electric charge to the surface of photo-sensitive drum 102 which turns to the direction indicated by an arrow shown in the drawing. The photo-sensitive drum 102 comprises a cylinder made of metal such as aluminum etc. with photo-sensitive material painted on its surface. And, it is supplied with electric charge uniformly over its surface by the charging roller 101. Then, its surface is partially lighted by exposer 103 comprised of an array of LED etc. And, only electric charge on the lighted part of surface is taken away, so as to form image to be printed.

On the other hand, toner feeding roller 105 feeds the developing roller 106 with the charged toner preserved in toner tank 104. And, the charged toner is transferred from the surface of developing roller 106 to non-charged part of the surface of photo-sensitive drum 102, by the pulling force of static electricity caused by the difference of electric potential between toner and photo-sensitive drum 102.

And, transfer roller 107 is given a certain electric potential which is able to attract the charged toner from the photo-sensitive drum 102 to transfer roller 107. Meanwhile, paper feeding roller 108 feeds a paper between the photo-sensitive drum 102 and transfer roller 107. The paper feeding roller 108 confronts backup roller 110, so as to put a paper between them. The paper feeding roller 108 is driven by a motor not shown in the drawings. And, the paper is carried from right hand side to left hand side in the drawings as the paper feeding roller turns.

Thus, the paper is carried to be put between photo-sensitive drum 102 and transfer roller 107. Then, the charged toner is transferred from the surface of photo-sensitive drum 102 to the surface of paper by the attraction force of static electricity caused from the electric potential of transfer roller 107. Here, the toner is not fixed to the paper.

And, the paper is carried to be put between fixing roller 111 and fixing backup roller 112. Then, the plastic material in toner is momentarily melted by the fixing roller 111 which is heated up to high temperature, so as to fix toner to the paper.

By the way, there are, for example, two heat emitting elements in the printer housing. One is the fixing roller 111 which fixes toner on papers with proper heat. The other is the processor 4 which processes making up of image data to be printed.

As for a printer, in general, cooling means like fan 23 is necessary to control heat for fixing toner. On the other hand, such cooling means is also necessary to control temperature of processor 4, because the processor 4 operates at proper temperature. And, effective cooling means is needed to keep the proper temperature, as process speed increases because printing speed becomes faster and resolution becomes higher in today's printer. Therefore, it is important to cool both of the two heat emitting elements sufficiently.

Meanwhile, the same cooling means for control fixing toner is used for controlling data processing, because it costs much to equip another cooling means. Therefore, two or three routes for leading wind are formed in the printer housing from the same cooling means to each of heat emitting elements.

However, there is a problem to be solved in this occasion. That is, the routes for wind can change according to the state of printer housing, for example, opening of the cover of housing or jamming of paper in the housing. Therefore, either of heat emitting elements cannot be cooled sufficiently.

And, not only printer but also other image forming apparatus such as image recording apparatus including facsimile, copying machine etc. or image presenting apparatus including display etc. has the same problem.

SUMMARY OF THE INVENTION

Therefore, the present invention adopts next configurations aiming at solving the problem mentioned above.

The first configuration comprises an image processing section for processing image data inputted from an external apparatus, an image forming section for forming image from the image data processed by the image processing section, a state detecting means to detect the state of said image forming apparatus, a state judging means to judge whether said image forming apparatus is in ordinary state or extraordinary state according to the state of said image forming apparatus and an operating mode changing means to change the operating mode of said image processing section into the other operating mode of different electricity consumption.

The second configuration comprises an image processing section for processing image data inputted from an external apparatus, an image forming section for forming image from the image data processed by the image processing section, a state detecting means to detect the state of said image forming apparatus, a state judging means to judge whether said image forming apparatus is in ordinary state or extraordinary state according to the state of said image forming apparatus and an operating frequency changing means to change the operating frequency of said image processing section into different operating frequency.

The last configuration comprises a memory, an access controlling means to control access to data in said memory, an image processing section for processing image data inputted from an external apparatus, an image forming section for forming image from the image data processed by the image processing section, a state detecting means to detect the state of said image forming apparatus, a state judging means to judge whether said image forming apparatus is in ordinary state or extraordinary state according to the state of said image forming apparatus and an access frequency changing means to change the access frequency for said memory into different access frequency.

DESCRIPTION OF THE PREFERRED EMBODIMENTS

Figure 1:
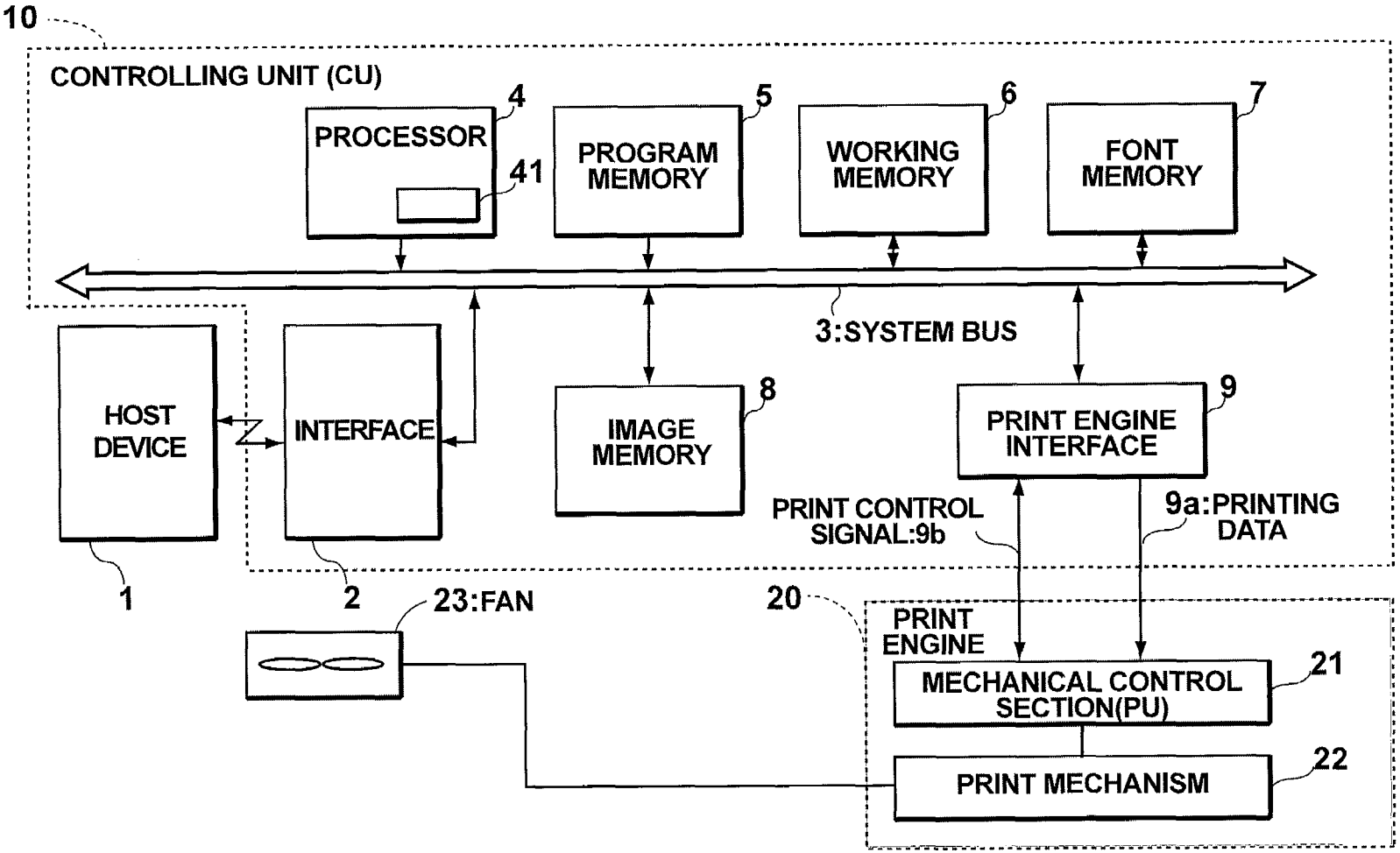
FIG. 1 is a block diagram showing a configuration of an image forming apparatus according to Embodiment 1.

Hereafter, preferred embodiments of the present invention are described referring to the drawings.

<Embodiment 1>

FIG. 1 shows a configuration of a printer as an example of image forming apparatus according to Embodiment 1 of present invention.

As shown in FIG. 1, a host device 1 is connected via interface 2 to system bus 3. And, processor 4, program ROM 5, working memory 6, font ROM 7, image memory 8, print engine interface 9 are connected to the system bus 3. Further, a print engine as image forming section 20 is connected to the print engine interface 9. Moreover, the processor 4 has a function of changing electricity consumption mode into low mode. So, it has a low electricity consumption changing register 41 for realizing this function.

An image processing section 10 is made up of elements from the interface 2 to the print engine interface 9. The image forming section 20 comprises controlling unit 21 and print mechanism 22. Moreover, fan 23 is equipped to the print mechanism 22. And, state detecting means 24 is equipped in the image forming section 20, so as to detect the physical state of the image forming section 20. For example, the state detecting means 24 comprises a sensor for detecting the cover of the printer housing opening or shutting.

The host device is what makes up data for printing, such as computer, word processor, image reader etc. And, the interface 2 is a circuit which comprises RS232C interface or parallel interface etc.

The processor 4 performs the overall control of the printer as an image forming apparatus. The control program which is executed in the processor 4 is installed in the program ROM 5. And, the low electricity consumption changing register 41 which is equipped in the processor 4 indicates "ON" or "OFF", so as to represent the low electricity consumption mode of halting circuits in the processor 4 which is not used or represent the ordinary mode of functioning all circuits in the processor 4.

The control program executed in processor 4 includes state judging means 44 and operating mode changing means 45. The former detects the cover of printer open or shut according to the signal from state detecting means 24. The latter controls the power supply to the processor 4 according to the representation in the low electricity consumption changing register 41.

Moreover, the working memory 6 is a memory for memorizing and managing data which is received or sending via the interface 2. And, the font ROM 7 is a memory which is used for transforming character code or other code received via the interface 2, into bitmap font data for printing.

Moreover, the image memory 8 comprises random access memory for containing for example one page of printing data which is an image data edited by the processor 4. The print engine 20 is a device which performs printing on papers according to the printing data contained in the image memory 8. It comprises paper carrier or electro-photographic process device etc.

The print engine interface 9 is an interface circuit for reading out printing data 9*a* from image memory 8 according to the indication of processor 4 to transfer it to print engine 20, or receiving print control signal 9*b* put out from print engine 20 to send it to processor 4 etc.

In the printer mentioned above, control command or character code, graphic code, bitmap image data etc. are temporarily contained in working memory 6 if necessary. And, it is transformed into image data for printing according to the control of processor 4, to be compiled on image memory 8.

Figure 2:
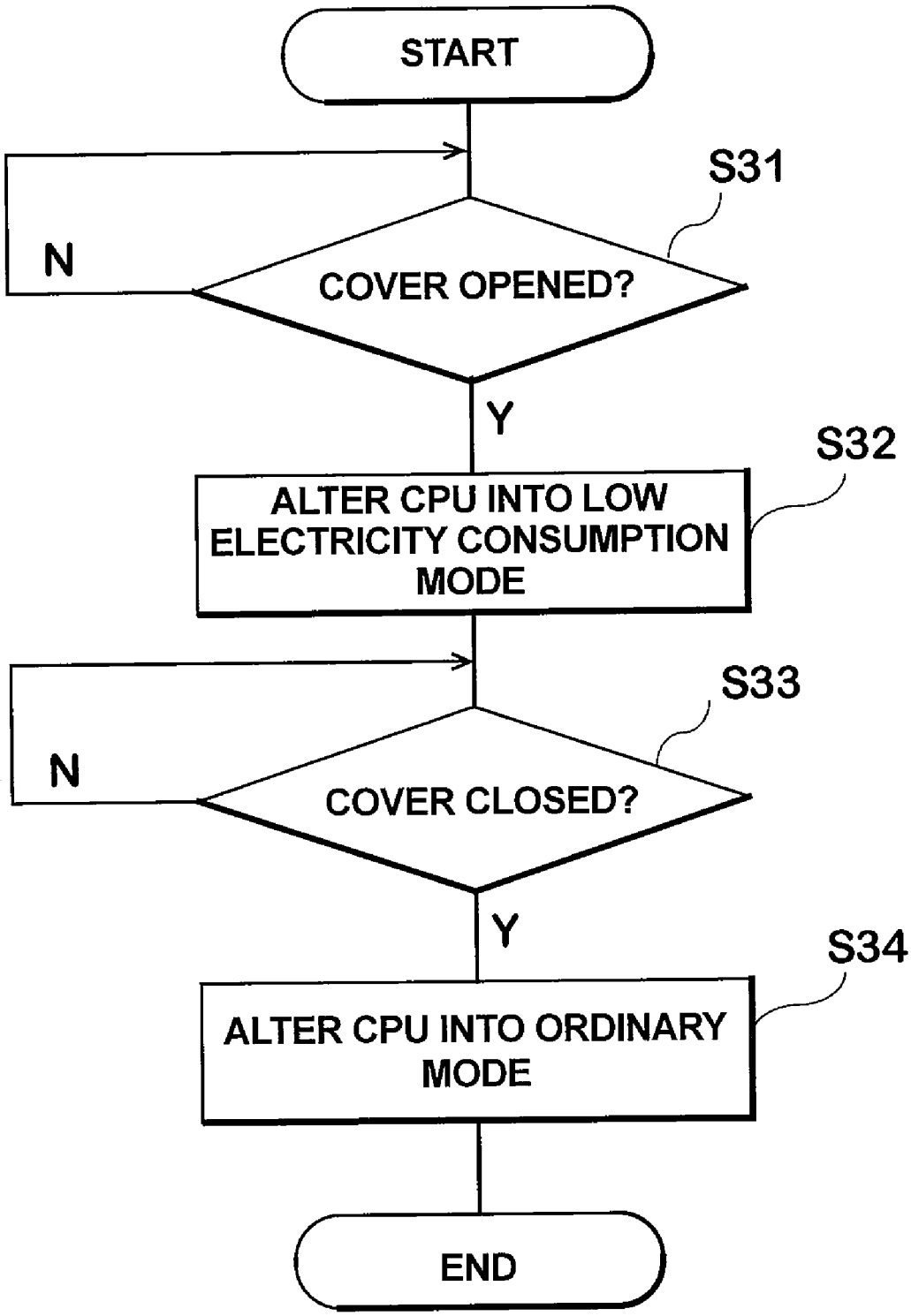
FIG. 2 shows a side view of the image forming apparatus of FIG. 1 when its cover is shut.

FIG. 2 shows the side view of the printer as image forming apparatus when the cover is shut.

In FIG. 2, charging roller 101 supplies electric charge to the surface of photo-sensitive drum 102. The photo-sensitive drum 102 comprises a cylinder made of metal such as aluminum etc. with photo-sensitive material painted on its surface. And, it is supplied with electric charge uniformly over its surface by the charging roller 101. Then, its surface is partially lighted by exposer 103 comprised of an array of LED etc. And, only electric charge on the lighted part of surface is taken away, so as to form image to be printed.

On the other hand, toner feeding roller 105 feeds the developing roller 106 with the charged toner preserved in toner tank 104. And, the charged toner is transferred from the surface of developing roller 106 to non-charged part of the surface of photo-sensitive drum 102, by the pulling force of static electricity caused by the difference of electric potential between toner and photo-sensitive drum 102.

And, transfer roller 107 is given a certain electric potential which is able to attract the charged toner from the photo-sensitive drum 102 to transfer roller 107. Meanwhile, paper feeding roller 108 feeds a paper between the photo-sensitive drum 102 and transfer roller 107. The paper feeding roller 108 confronts backup roller 110, so as to put a paper between them. The paper feeding roller 108 is driven by a motor not shown in the drawings. And, the paper is carried from right hand side to left hand side in the drawings as the paper feeding roller turns.

Thus, the paper is carried to be put between photo-sensitive drum 102 and transfer roller 107. Then, the charged toner is transferred from the surface of photo-sensitive drum 102 to the surface of paper by the attraction force of static electricity caused from the electric potential of transfer roller 107. Here, the toner is not fixed to the paper.

And, the paper is carried to be put between fixing roller 111 and fixing backup roller 112. Then, the plastic material in toner is momentarily melted by the fixing roller 111 which is heated up to high temperature, so as to fix toner to the paper. Here, the temperature of fixing roller 111 must be controlled to keep the best temperature for fixing.

Therefore, intake fan 23 and exhaust fan 23' are equipped. The intake fan 23 is located near one of the lower corner of the printer housing. And, the exhaust fan 23' is located near the opposite corner on the diagonal of housing. Thus, cooling wind is blown up from intake fan 23 to exhaust fan 23' through the ventilation pass of route B shown in FIG. 2.

Figure 3:
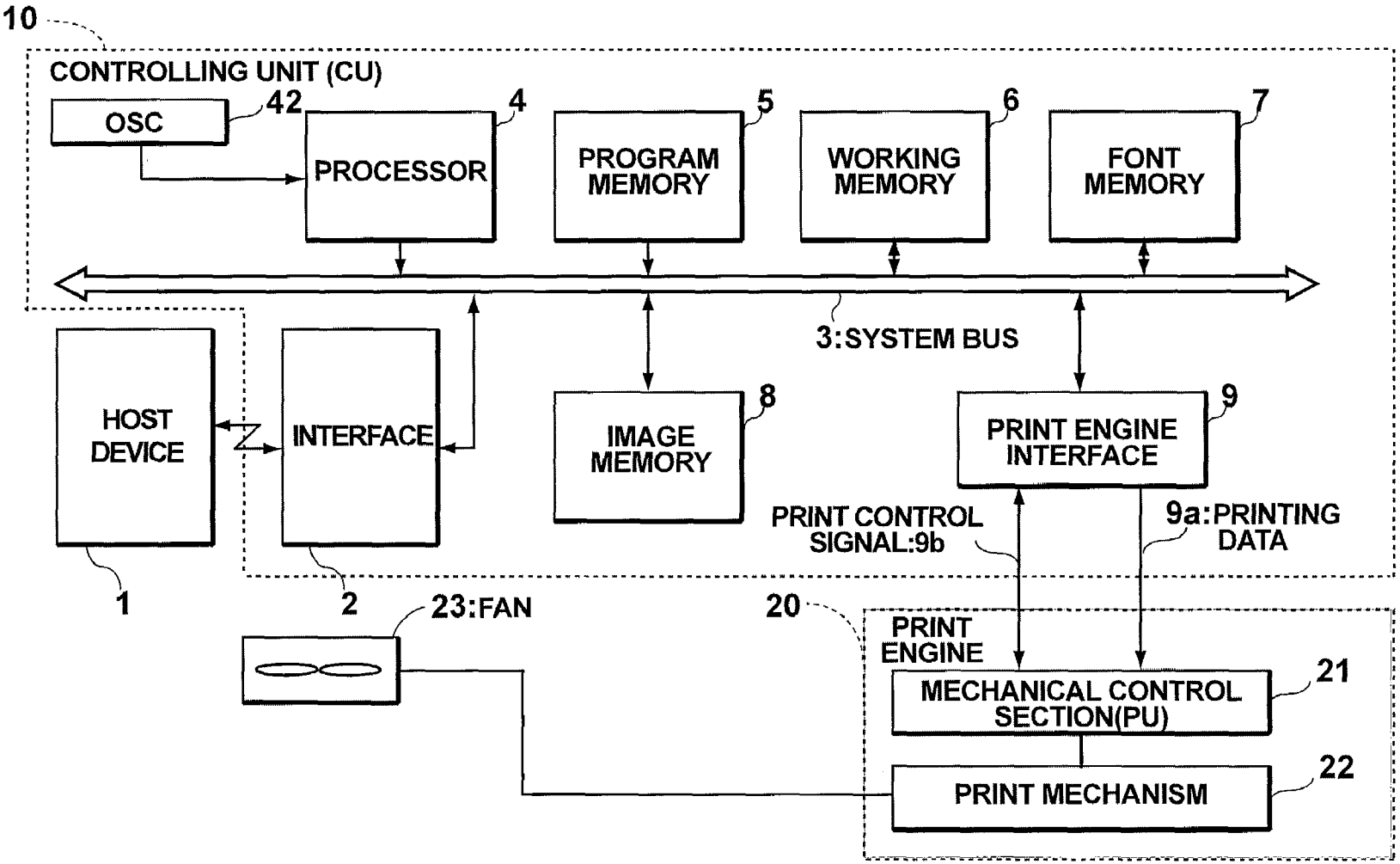
FIG. 3 shows a plan view of the image forming apparatus of FIG. 1 when its cover is shut.

FIG. 3 shows a plan view of the printer housing.

As shown in FIG. 3, there are three ventilation passes of route A, B and C in the printer housing.

The route A runs through the image processing section 10 which is equipped between the side frame 121 and the side cover of the printer housing. Thus, the hot air heated by the image processing section 10 is let out through route A.

The route B runs below the transfer roller 107 and runs above the fixing roller 111. Thus, the hot air heated by the fixing roller 111 is let out through route B.

The route C runs through the controlling unit 21 of image forming section 20 which is equipped between side frame 122 and side cover of printer housing. Thus, the hot air heated by the controlling unit 21 is let out through route C.

Figure 4:
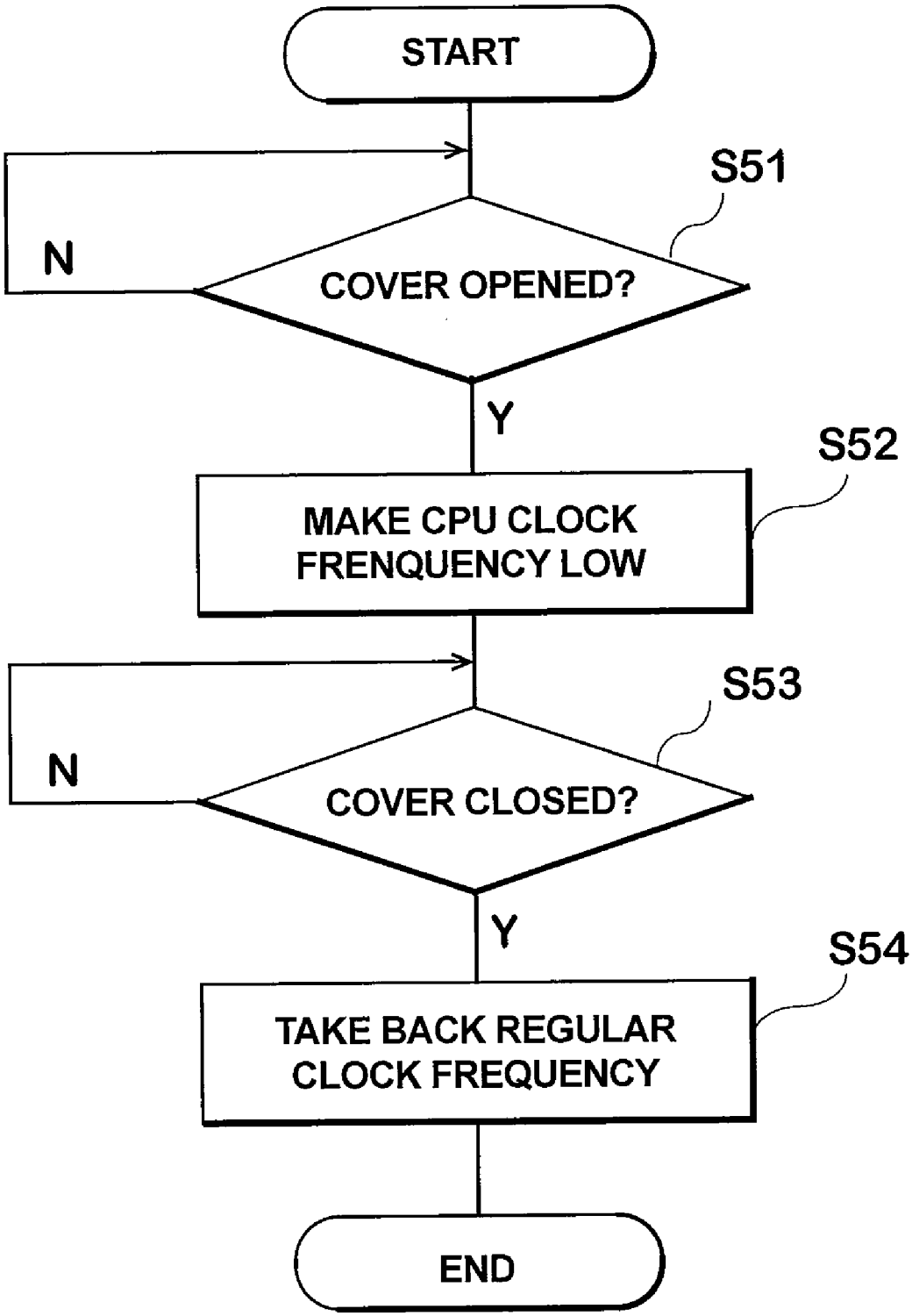
FIG. 4 shows a side view of the image forming apparatus of FIG. 1 when its cover is open.
Figure 5:
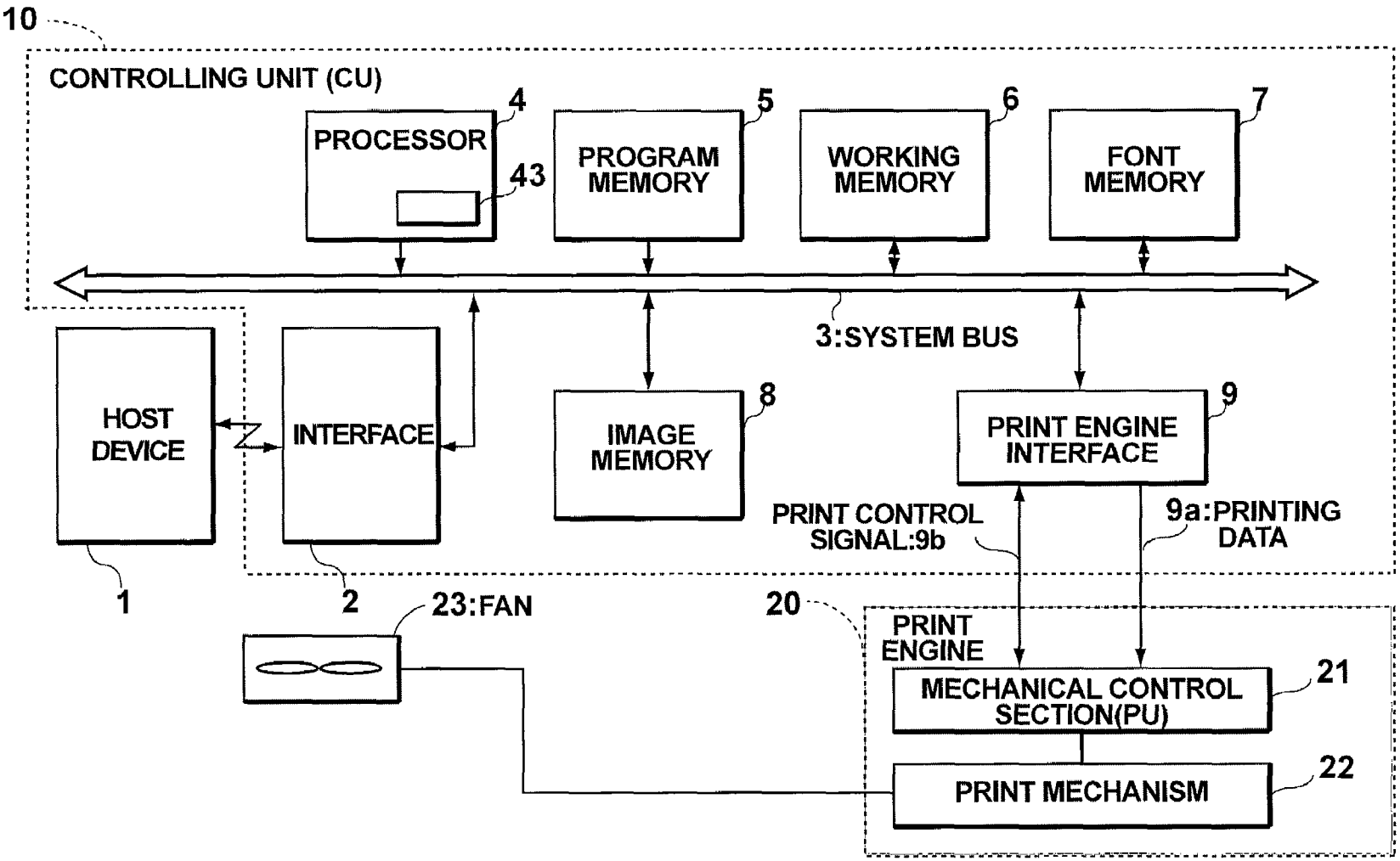
FIG. 5 shows a plan view of the image forming apparatus of FIG. 1 when its cover is open.

FIG. 4 shows the side view of the printer when the cover is open. And, FIG. 5 shows the plan view of the printer when the cover is open.

As shown in FIG. 4, almost all the air let in by the intake fan 23 is let out from the upper opening when the cover is open. So, as shown in FIG. 5, only small quantity of wind is let out from the exhaust fan 23'. And, little wind blows in each of route A' and route C'. Therefore, little cooling effect is given to each of the image processing section 10 and the controlling unit 21.

<Operation of Embodiment 1>

Figure 6:
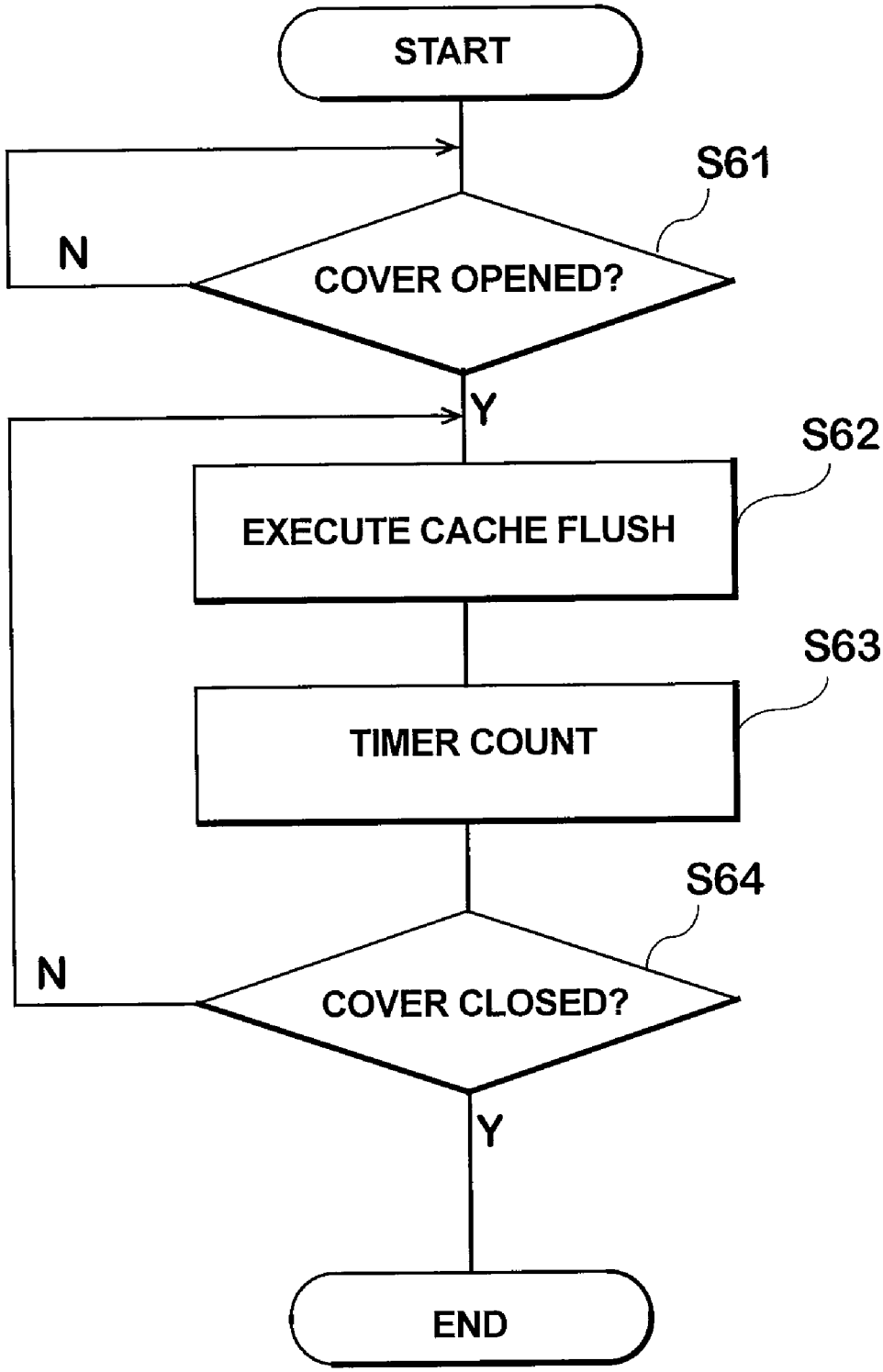
FIG. 6 is a flowchart showing the operation of the image forming apparatus of FIG. 1.

The operation of the printer according to Embodiment 1 of present invention is described referring to the flowchart shown in FIG. 6. In addition, in description to be mentioned below, opening of the cover of printer housing is adopted as a parameter for predicting cooling ability drop. But, it can also be predicted by other parameters. An example of this is paper jam in printer which disturbs the wind blowing in the ventilation pass of printer.

When the power-supplying switch of printer is turned on, at first, the state judging means 44 judges whether the cover of printer is opened or not. Unless the cover is opened, it keeps watching the cover opening or shutting (step S31).

If the cover of printer is opened by the user own or some other person for some reason, the low electricity consumption mode is set to the low electricity consumption changing register 41 of processor 4 by the operating mode changing means 45 (step S32). By this mode setting, processor 4 enters in the low electricity consumption mode. And, the power supply to the circuits which are not operating in processor 4 is shut off. As a result, heating of processor 4 is lowered. While the cover is opening, the low electricity consumption changing register is kept "ON". And, the low electricity consumption mode of processor 4 is kept. As a result, the temperature of processor 4 goes down.

If the state judging means 44 detects the cover getting shut by the user or somebody (step S33), the operating mode changing means 45 changes the low electricity consumption mode register 41 into "OFF", so as to get processor 4 returned from the low electricity consumption mode to the ordinary mode (step S34).

In addition, as shown in FIG. 2, in the occasion when the paper jammed between the transfer roller 107 and fixing roller 111, it crosses the route B. So, the cooling wind blows below the fixing backup roller 112. As a result, cooling effect to the fixing roller 111 which has a heater, becomes weak. In such occasion like this, similar effect is obtained by adopting present invention.

Moreover, the present invention is not applied to printer but also applied to facsimile or copying machine which cover are able to be opened or shut. Further, it is also applied to image presenting apparatus which is equipped with a image presenting section instead of the image recording section.

<Effect of Embodiment 1>

As mentioned above, according to Embodiment 1, the invention can provide a printer which is able to keep down the temperature of it easily and at low cost without equipping extra fan to the image processing section even if the printer should go into an extraordinary state such as cover opening or paper jam in the printer, because it can keep the temperature rise under control with the low electricity consumption mode of processor 4 when the cooling ability drop occurred from insufficient flow of wind to the cooling subject owing to the internal wind pass change in the printer which cover was opened or paper jammed.

<Embodiment 2>

Figure 7:
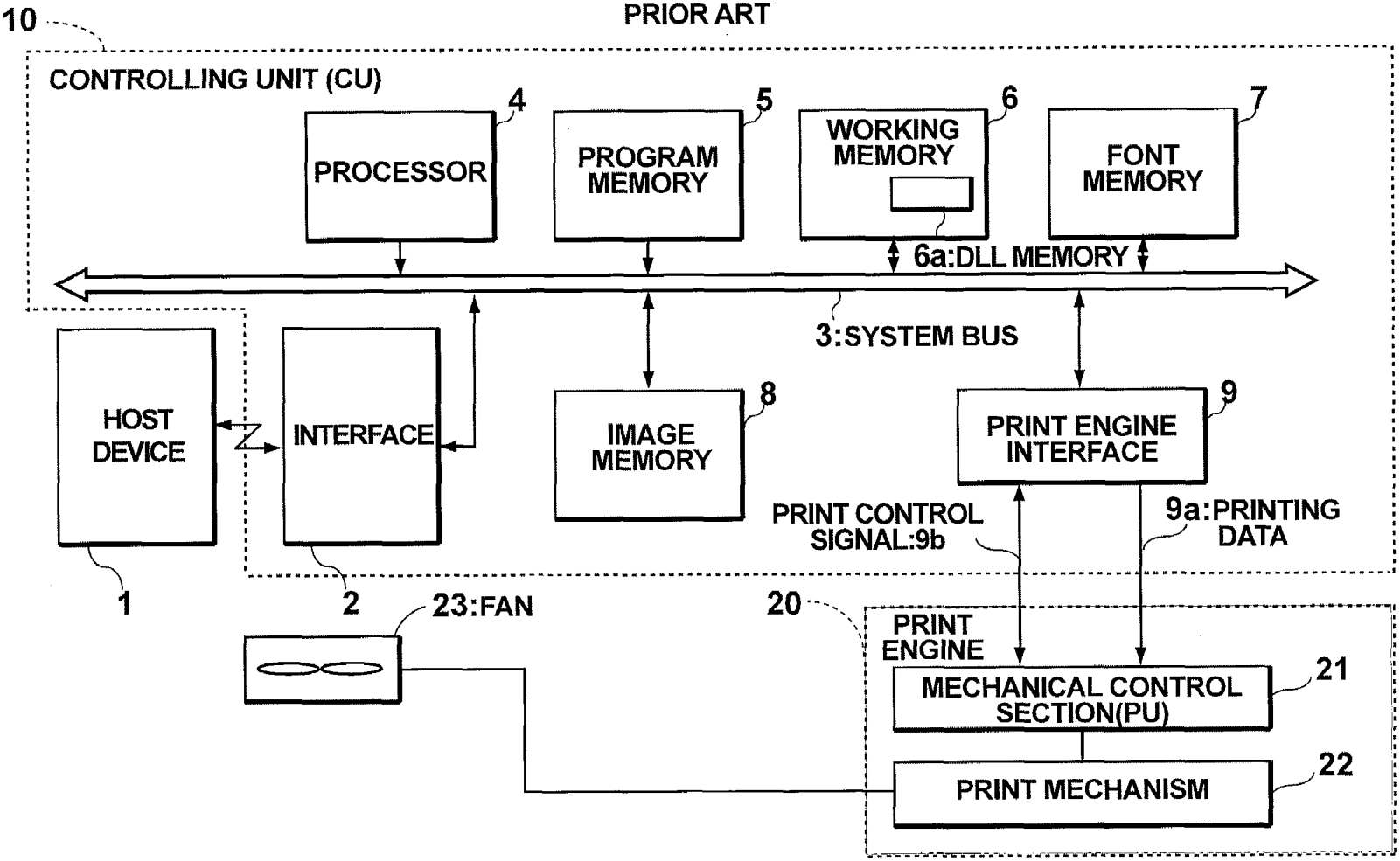
FIG.7 PRIOR ART
FIG. 7 is a block diagram showing a configuration of an image forming apparatus according to Embodiment 2.

FIG. 7 shows a configuration of a printer as an example of image forming apparatus according to Embodiment 2 of present invention.

As shown in FIG. 7, a host device 1 is connected via interface 2 to system bus 3. And, processor 4, program ROM 5, working memory 6, font ROM 7, image memory 8, print engine interface 9 are connected to the system bus 3. Further, a print engine as image forming section 20 is connected to the print engine interface 9. Moreover, an oscillator (OSC) 42 is connected to the processor 4. This oscillator 42 is able to change its clock frequency.

An image processing section 10 is made up of elements from the interface 2 to the print engine interface 9. The image forming section 20 comprises controlling unit 21 and print mechanism 22. Moreover, fan 23 is equipped to the print mechanism 22, so as to cool the print mechanism 22 and the image processing section 10. And, state detecting means 24 is equipped in the image forming section 20, so as to detect the physical state of the image forming section 20. For example, the state detecting means 24 comprises a sensor for detecting the cover of the printer housing opening or shutting.

The host device 1 is what makes up data for printing, such as computer, word processor, image reader etc. And, the interface 2 is a circuit which comprises RS232C interface or parallel interface etc.

The processor 4 performs the overall control of the printer as an image forming apparatus. The control program which is executed in the processor 4 is installed in the program ROM 5. And, the oscillator 42 connected to the processor 4 changes its clock frequency according to the indication of processor 4.

The control program executed in processor 4 includes state judging means 44 and operating frequency changing means 46. The former detects the cover of printer open or shut according to the signal from state detecting means 24. The latter indicates the clock frequency of the oscillator 42 according to the judgement of state judging means 44.

Moreover the working memory 6 is a memory for memorizing and managing data which is received or sending via the interface 2. And, the font ROM 7 is a memory which is used for transforming character code or other code received via the interface 2, into bitmap font data for printing.

Moreover, the image memory 8 comprises random access memory for containing for example one page of printing data which is an image data edited by the processor 4. The print engine 20 is a device which performs printing on papers according to the printing data contained in the image memory 8. It comprises paper carrier or electro-photographic process device etc.

The print engine interface 9 is an interface circuit for reading out printing data 9*a* from image memory 8 according to the indication of processor 4 to transfer it to print engine 20, or receiving print control signal 9*b* put out from print engine 20 to send it to processor 4 etc.

In the printer mentioned above, control command or character code, graphic code, bitmap image data etc. are temporarily contained in working memory 6 if necessary. And, it is transformed into image data for printing according to the control of processor 4, to be compiled on image memory 8.

<Operation of Embodiment 2>

Figure 8:
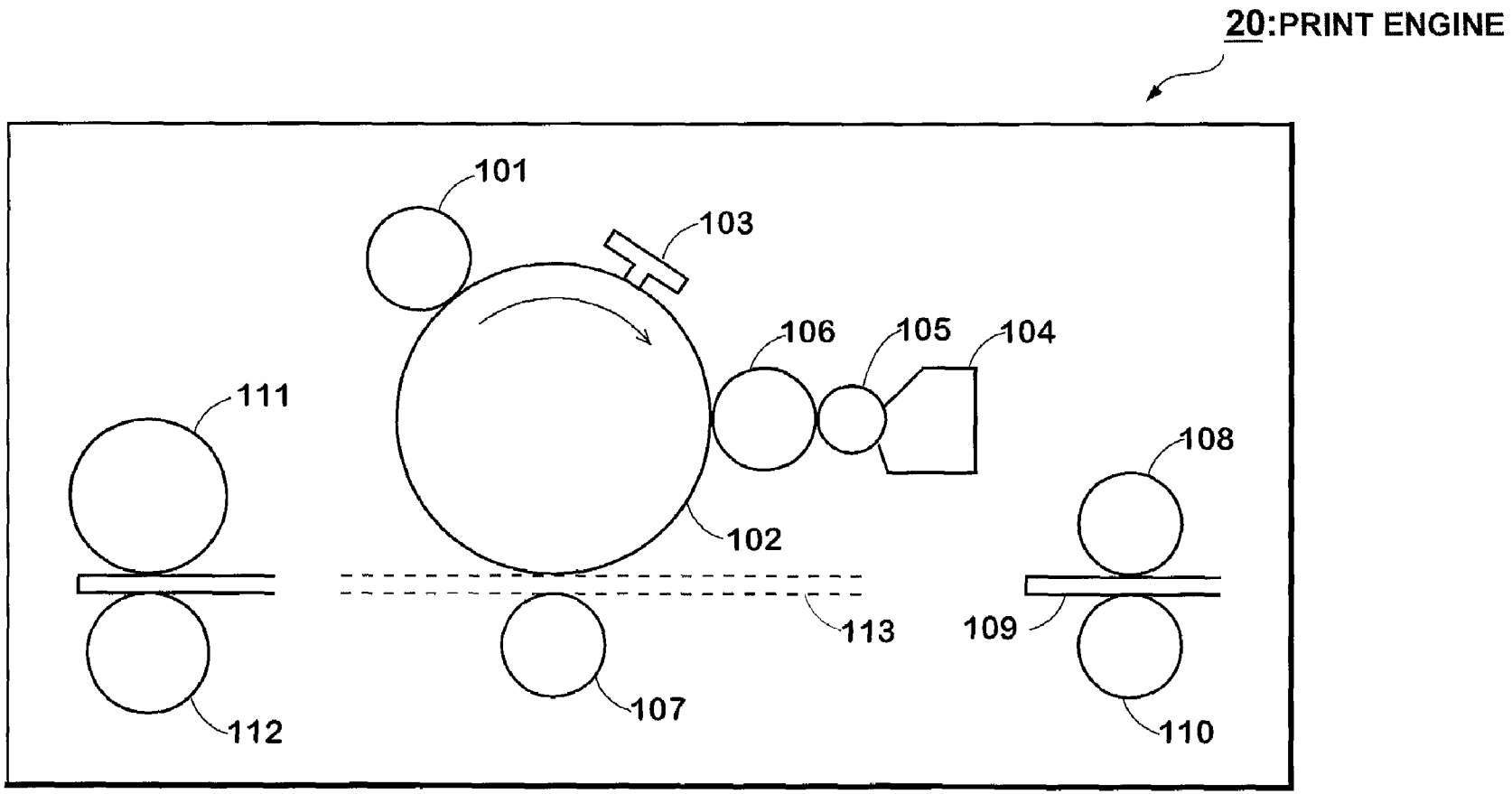
FIG. 8 is a flowchart showing the operation of the image forming apparatus of FIG. 7.

The operation of the printer according to Embodiment 2 of present invention is described referring to the flowchart shown in FIG. 8. In addition, in description to be mentioned below, opening of the cover of printer housing is adopted as a parameter for predicting cooling ability drop. But, it can also be predicted by other parameters. An example of this is paper jam in printer which disturbs the wind blowing in the ventilation pass of printer.

When the power-supplying switch of printer is turned on, at first, the state judging means 44 judges whether the cover of printer is opened or not. Unless the cover is opened, it keeps watching the cover opening or shutting (step S51).

If the cover of printer is opened by the user own or some other person for some reason, the prescribed value n-Low set in advance at the oscillator 42 to slow down the operation speed of processor 4 is selected by the operating frequency changing means 46 (step S52). By this selecting, processor 4 operates with low clock frequency. As a result, heating of processor 4 is lowered. While the cover is opening, the low clock frequency is kept. And, the slow operation of processor 4 is kept. As a result, the temperature of processor 4 goes down.

If the state judging means 44 detects the cover getting shut by the user or somebody (step S53), the operating frequency changing means 46 changes the low clock frequency into the ordinary frequency, so as to get processor 4 returned from the slow operation to the ordinary operation (step S54).

<Effect of Embodiment 2>

As mentioned above, according to Embodiment 2, the invention can provide a printer which is able to keep down the temperature of it easily and at low cost without equipping extra fan to the image processing section even if the printer should go into an extraordinary state such as cover opening or paper jam in the printer, because it can keep the temperature rise under control with the control of lowering operating frequency of processor 4 when the cooling ability drop occurred from insufficient flow of wind to the cooling subject owing to the internal wind pass change in the printer which cover was opened or paper jammed.

<Embodiment 3>

Although the basic configuration of the apparatus of Embodiment 3 is almost the same as Embodiment 1 or 2, a significant difference is that the processor 4 in the third embodiment has a cache memory. Additionally, the apparatus of the third embodiment does not have neither a means for changing into low electricity consumption mode nor a means for slowing down the operation speed of the processor 4.

Figure 9:
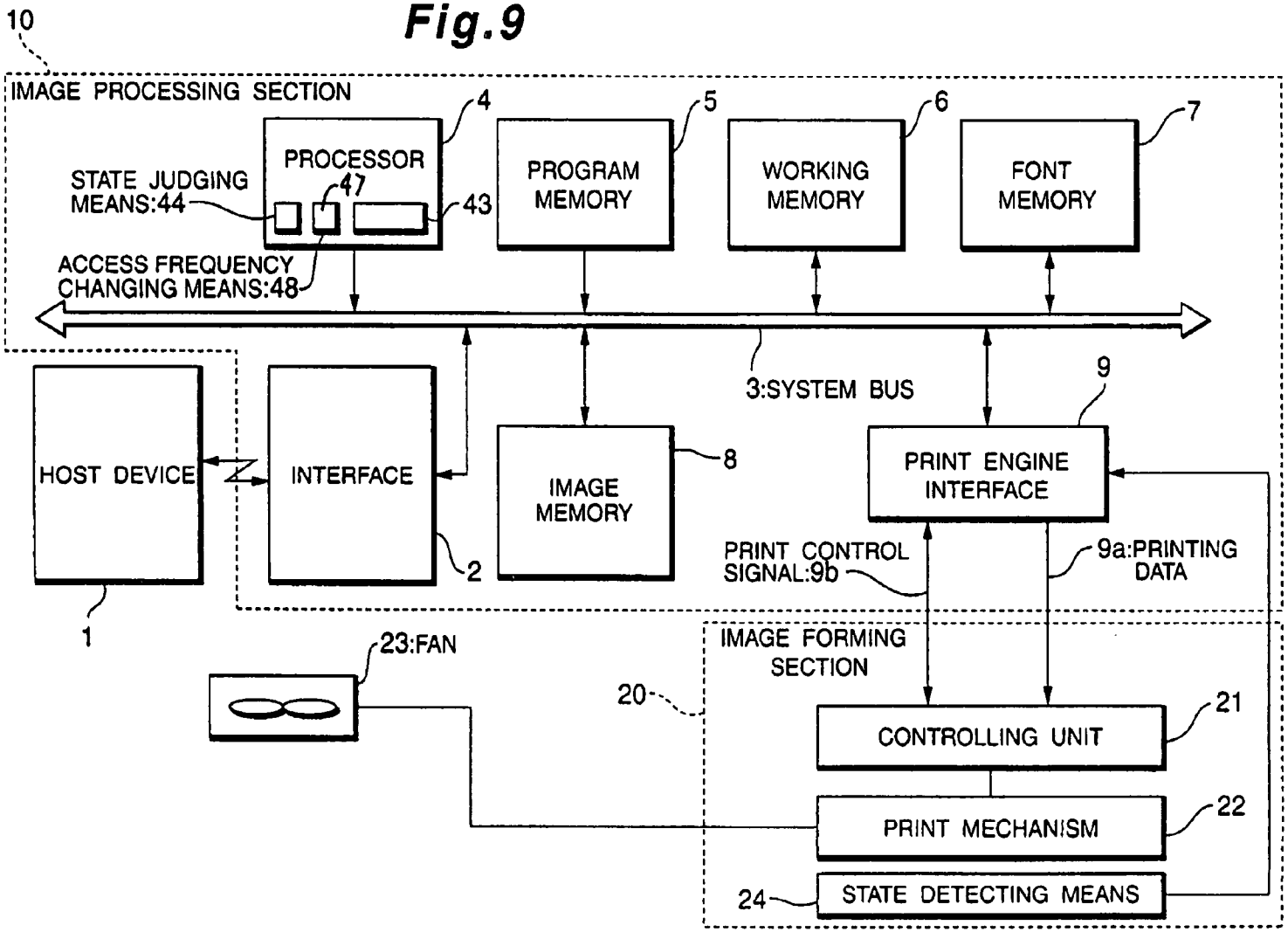
FIG. 9 is a block diagram showing a configuration of an image forming apparatus according to Embodiment 3.

FIG. 9 shows a configuration of a printer as an example of image forming apparatus according to Embodiment 3 of present invention.

As shown in FIG. 9, a host device 1 is connected via interface 2 to system bus 3. And, processor 4, program ROM 5, working memory 6, font ROM 7, image memory 8, print engine interface 9 are connected to the system bus 3. Further, a print engine as image forming section 20 is connected to the print engine interface 9. Moreover, the processor 4 has a cache memory 43.

An image processing section 10 is made up of elements from the interface 2 to the print engine interface 9. The image forming section 20 comprises controlling unit 21 and print mechanism 22. Moreover, fan 23 is equipped to the print mechanism 22. And, state detecting means 24 is equipped in the image forming section 20, so as to detect the physical state of the image forming section 20. For example, the state detecting means 24 comprises a sensor for detecting the cover of the printer housing opening or shutting.

The host device 1 is what makes up data for printing, such as computer, word processor, image reader etc. And, the interface 2 is a circuit which comprises RS232C interface or parallel interface etc.

The processor 4 performs the overall control of the printer as an image forming apparatus. The control program which is executed in the processor 4 is installed in the program ROM 5. A cache memory 43 is equipped in the processor 4. The cache memory 43 memorizes the contents of other memories outside of the processor 4, that is program memory 5, working memory 6, font memory 7 or image memory 8, which have ever been accessed. Thus, the cache memory 43 enables access to the same contents rapidly.

The control program executed in processor 4 includes state judging means 44, access controlling means 47 and access frequency changing means 48. The first detects the cover of the printer open or shut according to the signal from the state detecting means 24. The second controls access to data in the cache memory 43. For example, it controls not getting access to the cache memory 43 but the other memory which contains original data, by flushing data in the cache memory 43. The last controls access frequency to the cache memory 43, for example, by flushing data in the cache memory 43. Thus, the cache memory 43 is temporarily without access to the original data. So, by adopting cache flush, the access controlling means 47 and access frequency changing means 48 are embodied in the same means.

Moreover, the working memory 6 is a memory for memorizing and managing data which is received or sending via the interface 2. And, the font ROM 7 is a memory which is used for transforming character code or other code received via the interface 2, into bitmap font data for printing.

Moreover, the image memory 8 comprises random access memory for containing for example one page of printing data which is an image data edited by the processor 4. The print engine 20 is a device which performs printing on papers according to the printing data contained in the image memory 8. It comprises paper carrier or electro-photographic process device etc.

The print engine interface 9 is an interface circuit for reading out printing data 9*a* from image memory 8 according to the indication of processor 4 to transfer it to print engine 20, or receiving print control signal 9*b* put out from print engine 20 to send it to processor 4 etc.

In the printer mentioned above, control command or character code, graphic code, bitmap image data etc. are temporarily contained in working memory 6 if necessary. And, it is transformed into image data for printing according to the control of processor 4, to be compiled on image memory 8.

<Operation of Embodiment 3>

Figure 10:
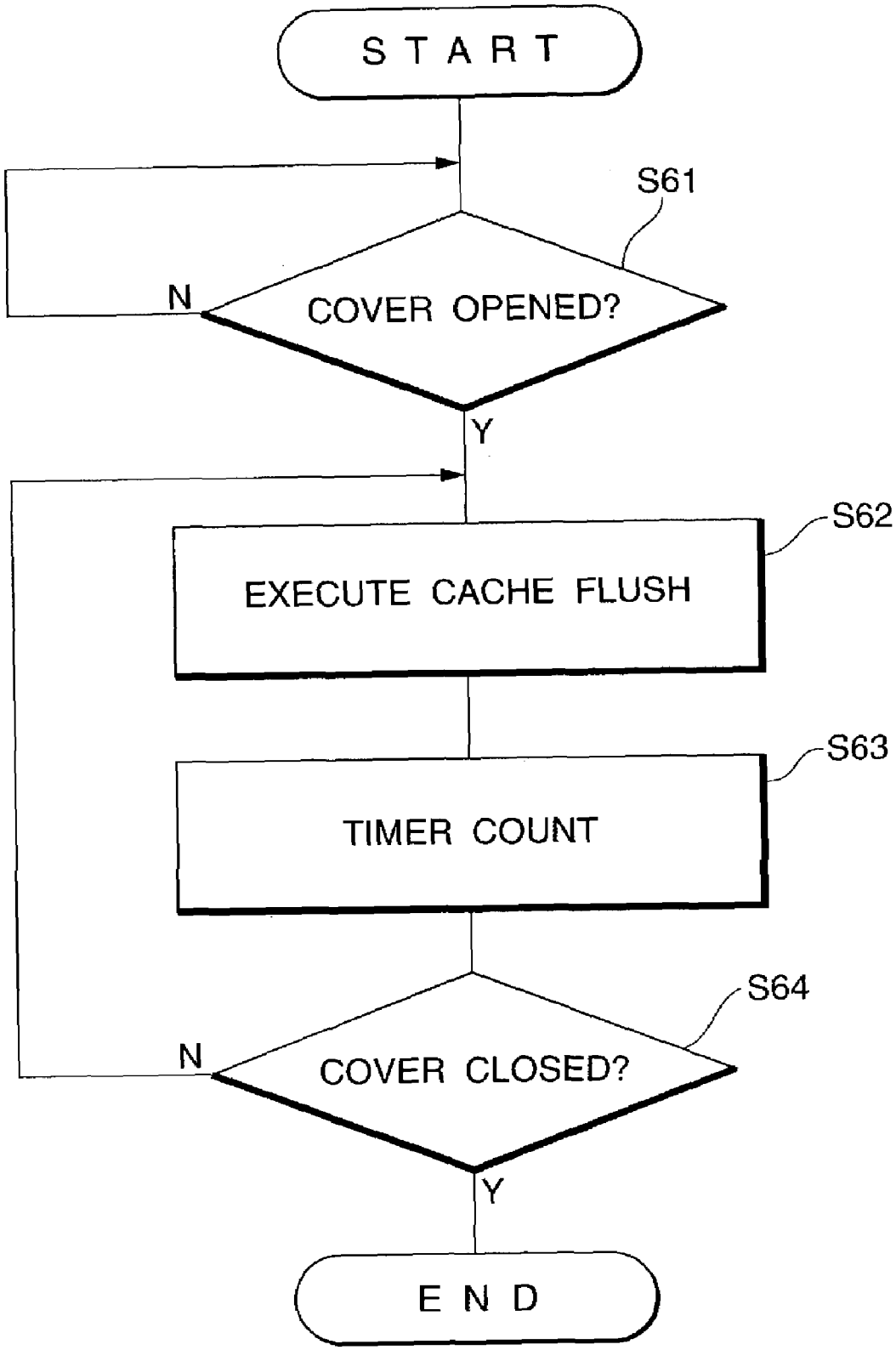
FIG. 10 is a flowchart showing the operation of the image forming apparatus of FIG. 9.
Figure 11:
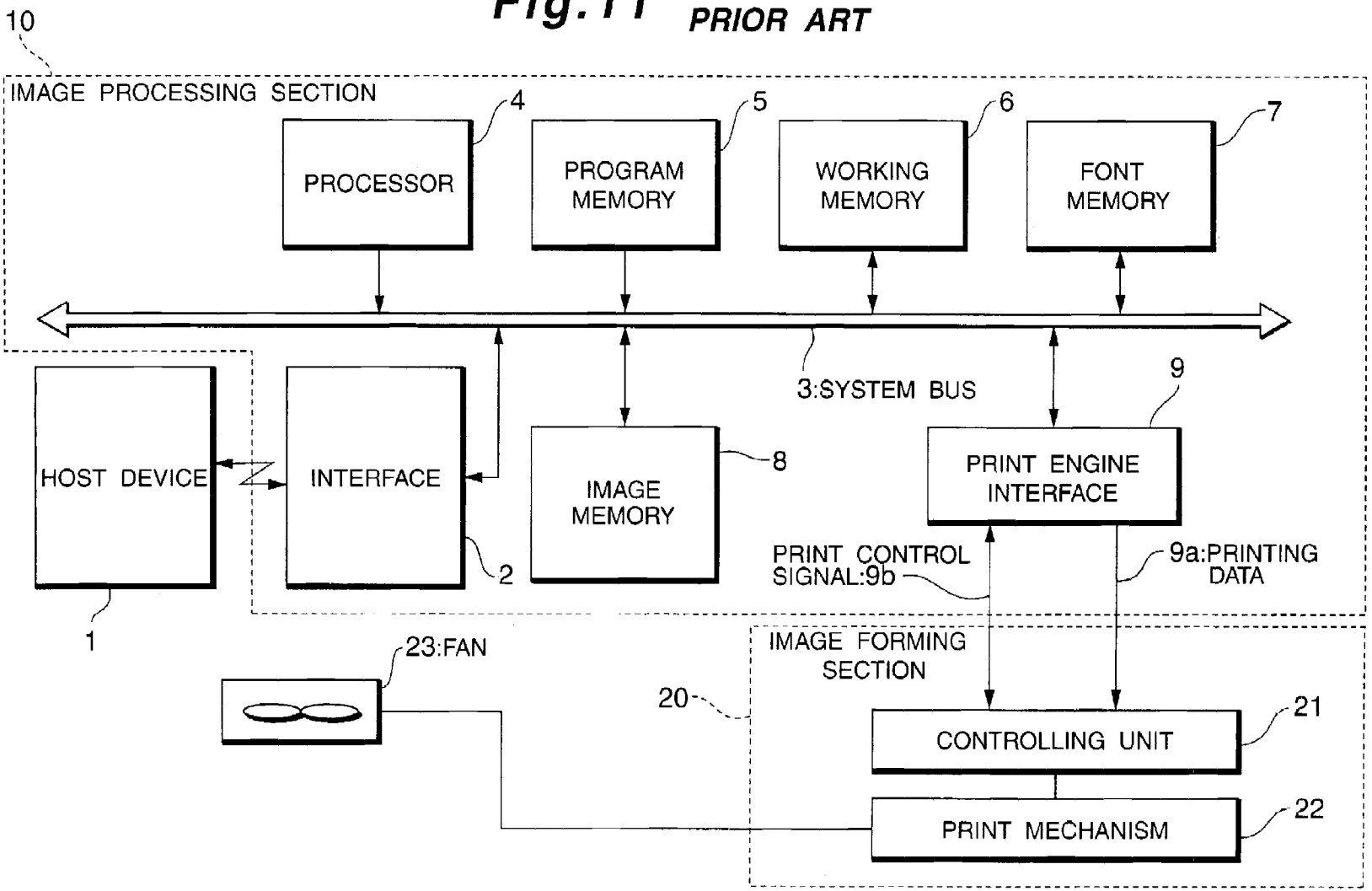
Fig.11 PRIOR ART
FIG. 11 is a block diagram showing a configuration of a conventional image forming apparatus.
Figure 12:
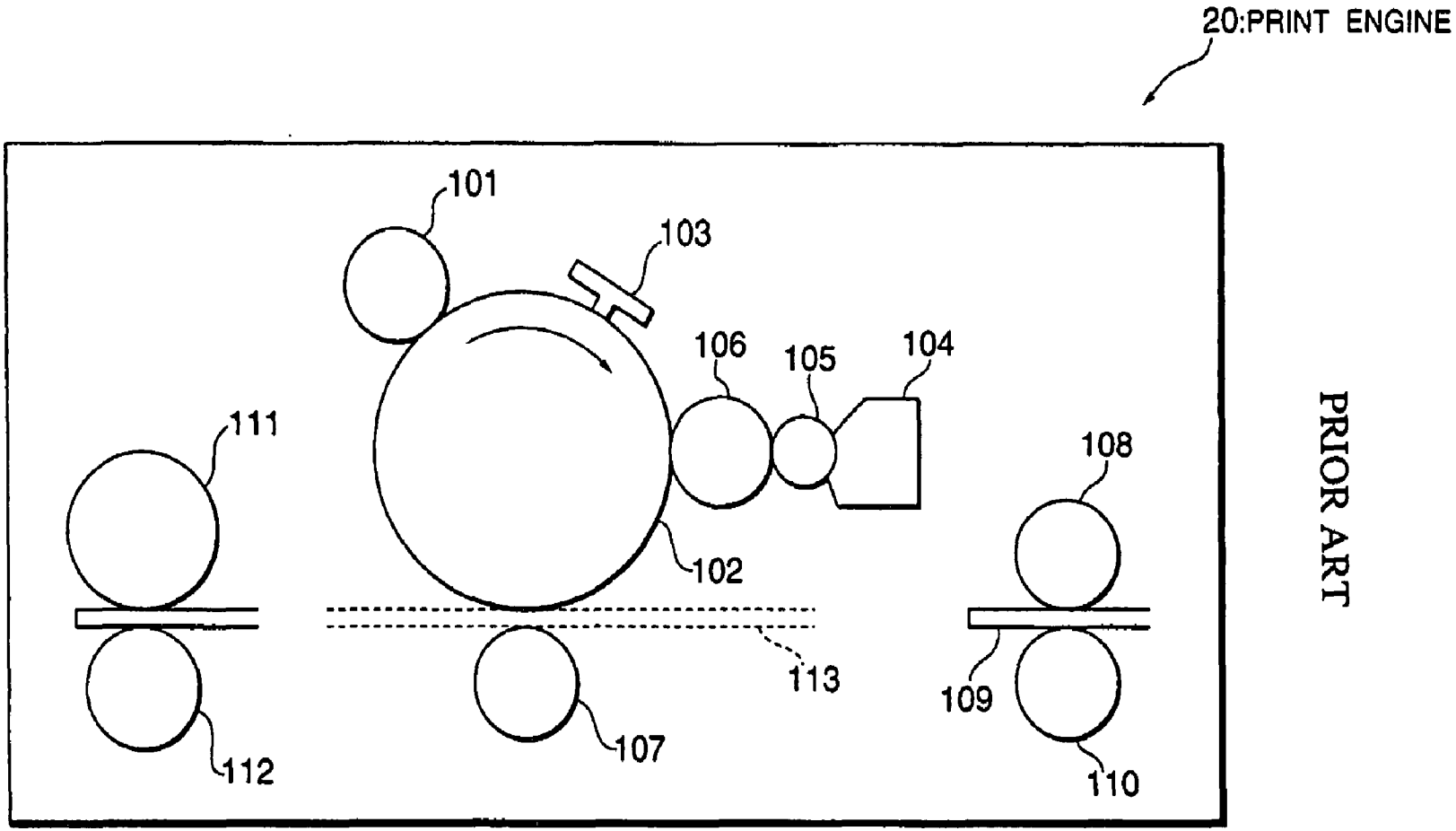
FIG. 12 shows a plan view of a general printer by electro-photography.

The operation of the printer according to Embodiment 3 of present invention is described referring to the flowchart shown in FIG. 10. In addition, in description to be mentioned below, opening of the cover of printer housing is adopted as a parameter for predicting cooling ability drop. But, it can also be predicted by other parameters. An example of this is paper jam in printer which disturbs the wind blowing in the ventilation pass of printer.

When the power-supplying switch of printer is turned on, at first, the state judging means 44 judges whether the cover of printer is opened or not. Unless the cover is opened, it keeps watching the cover opening or shutting (step S61).

If the cover of printer is opened by the user own or some other person, cache flush control is performed to clear away the contents of cache memory 43, so as to miss the cache memory 43 (step S62). By this setting, processor 4 is made not to hit the cache memory 43. So, it becomes not to operate rapidly. And, the processor 4 has a long wait for access because it cannot hit the cache memory 43. As a result, the operating frequency is relatively lowered. Then, the electricity consumption in processor 4 is lowered. And, at the same time, the temperature of processor 4 goes down. In addition, this cache flush control can be performed by either of cache memory's own function or processor's own writing function.

Next, the processor 4 has a wait of a prescribed time with timer's counting (step S63). Thus, the cache flush is not performed for the prescribed time. These steps S62, S63 and S64 are repeated until the cover of printer is shut by the user or somebody.

If the state judging means 44 detects the cover getting shut by the user or somebody (step S64), these steps S62, S63 and S64 are not repeated no longer, so as to get processor 4 returned from the low electricity consumption mode of cache flush to the ordinary mode.

<Effect of Embodiment 3>

As mentioned above, according to Embodiment 3, the invention can provide a printer which is able to avoid extraordinary temperature rise in it easily and at low cost without equipping extra fan or other costly cooling system to the image processing section even if the printer should go into an extraordinary state such as cover opening or paper jam in the printer, because it can keep the temperature rise under control with the cache flush in processor 4 which drops access frequency of processor 4 when the cooling ability drop occurred from insufficient flow of wind to the cooling subject owing to the internal wind pass change in the printer which cover was opened or paper jammed.

<Other Embodiment>

In each Embodiment mentioned above, described is a temperature controlling apparatus of detecting only one kind of extraordinary state of apparatus. That is either of the cover open state or paper jammed state etc. But, the present invention is not limited to this, it can also be embodied in apparatus which can detect more than two kinds of extraordinary state. For example, both of cover open state and paper jammed state are detected. And, two kinds of temperature control are performed about two kinds of state respectively; because changes of wind blowing pass in the apparatus are different between cover open and paper jam, and temperature rises are different.

Moreover, control of the processor 4 is described in each Embodiment mentioned above. But, the temperature control is also adopted to the other part of the image processing section 10 or the controlling unit 21 of image forming section 20. And, the oscillator 42 in FIG. 7 can be equipped inside of the processor 4. Further, other elements than the processor 4 can be replaced by different form of elements which have similar function. And, the print engine as image forming section 20 can be replaced by other printing means than electro-photography means.

What is claimed is:

1. An image forming apparatus comprising:

(a) an image processing section for generating image data for printing from image data inputted from an external apparatus;

(b) an image forming section for forming an image from the image data generated by the image processing section;

(c) a state detecting means for detecting a physical state of the image forming apparatus;

(d) a processor configured to determine whether said image forming apparatus is in an ordinary physical state or an extraordinary physical state according to the physical state which is detected by said state detecting means; and (e) an operating mode changing means configured to change said image processing section between a first operating mode and a second operating mode, the second operating mode having heat emission less than in the first operating mode, wherein said image processing section is changed by said operating mode changing means from the first operating mode to the second operating mode when said processor determines that said image forming apparatus is in the extraordinary physical state, and wherein said image processing section is changed by said operating mode changing means from the second operating mode to the first operating mode when said processor determines that said image forming apparatus has returned from the extraordinary physical state to the ordinary physical state.

2. The image forming apparatus of claim 1 wherein said state detecting means can detect a cover of said image forming apparatus being in an open state or a closed state, the processor determining that the image forming apparatus is in the extraordinary physical state when the cover is open.

3. The image forming apparatus of claim 1 wherein said state detecting means detects a transforming state of a printing media.

4. The image forming apparatus of claim 1 wherein the state detecting means can detect a paper jam in the image forming apparatus, the processor determining that that image forming apparatus is in the extraordinary physical state when a paper jam is detected.

5. The image forming apparatus of claim 2 wherein the image forming apparatus is a printer and the cover of the image forming apparatus is the cover of the printer housing.

6. An image forming apparatus comprising:

(a) an image processing section for generating image data for printing from image data inputted from an external apparatus;

(b) an image forming section for forming an image from the image data generated by the image processing section;

(c) a state detecting means for detecting a physical state of the image forming apparatus;

(d) a processor configured to determine whether said image forming apparatus is in an ordinary physical state or an extraordinary physical state according to the physical state which is detected by said state detecting means; and (e) an operating frequency changing means to change a first operating frequency of said image processing section into a second operating frequency, the second operating frequency having heat emission less than the first operating frequency, wherein said image processing section is changed by said operating frequency changing means from the first operating frequency to the second operating frequency when said processor determines that said image forming apparatus is in the extraordinary physical state, and wherein said image processing section is changed by said operating frequency changing means from the second operating frequency to the first operating frequency when said processor determines that said image forming apparatus has returned from the extraordinary physical state to the ordinary physical state.

7. The image forming apparatus of claim 6 wherein said state detecting means can detect a cover of said image forming apparatus being in an open state or a closed state, the processor determining that that image forming apparatus is in the extraordinary physical state when the cover is open.

8. The image forming apparatus of claim 6 wherein said state detecting means detects a transforming state of a printing media.

9. The image forming apparatus of claim 6 wherein the state detecting means can detect a paper jam in the image forming apparatus, the processor determining that that image forming apparatus is in the extraordinary physical state when a paper jam is detected.

10. The image forming apparatus of claim 6 wherein the image processing section includes a processor having an operating frequency, wherein the operating frequency changing means changes the operating frequency of the processor between the first operating frequency and the second operating frequency.

11. The image forming apparatus of claim 7 wherein the image forming apparatus is a printer and the cover of the image forming apparatus is the cover of the printer housing.

12. An image forming apparatus comprising:

(a) a memory;

(b) an access controlling means to control access to data in said memory;

(c) an image processing section for generating image data inputted from an external apparatus;

(d) an image forming section for forming an image from the image data generated by the image processing section;

(e) a state detecting means to detect a state of said image forming apparatus;

(f) a state judging means to determine whether said image forming apparatus is in an ordinary state or an extraordinary state according to the state of said image forming apparatus which is detected by said state detecting means; and (g) an access frequency changing means to change a first access frequency for said memory into a second access frequency, wherein a frequency for accessing said memory is changed by said access frequency changing means from the first access frequency to the second access frequency which is lower than the first access frequency when said state judging means detects that said image forming apparatus is in an extraordinary state, and wherein the frequency for accessing said memory is changed by said access frequency changing means from the second access frequency to the first access frequency when said state judging means detects that said image forming apparatus has returned from the extraordinary state to the ordinary state.

13. The image forming apparatus of claim 12 wherein said state detecting means can detect a cover of said image forming apparatus being in an open state or a closed state, the state judging means determining that that image forming apparatus is in the extraordinary state when the cover is open.

14. The image forming apparatus of claim 12 wherein said state detecting means detects a transforming state of a printing media.

15. The image forming apparatus of claim 12 wherein the state detecting means can detect a paper jam in the image forming apparatus, the state judging means determining that that image forming apparatus is in the extraordinary state when a paper jam is detected.

16. The image forming apparatus of claim 13 wherein the image forming apparatus is a printer and the cover of the image forming apparatus is the cover of the printer housing.

* * * * *